US006364143B1

(12) United States Patent
Knierbein

(10) Patent No.: US 6,364,143 B1
(45) Date of Patent: Apr. 2, 2002

(54) STERILE CONNECTOR FOR CONTAINERS WHICH CONTAIN MEDICINAL LIQUIDS

(75) Inventor: Bernd Knierbein, Neu-Anspach (DE)

(73) Assignee: Fresenius AG, Bad Homburg (DE)

( * ) Notice: Subject to any disclaimer, the term of this patent is extended or adjusted under 35 U.S.C. 154(b) by 0 days.

(21) Appl. No.: 09/701,447

(22) PCT Filed: Jul. 7, 1999

(86) PCT No.: PCT/EP99/04776

§ 371 Date: Nov. 27, 2000

§ 102(e) Date: Nov. 27, 2000

(87) PCT Pub. No.: WO00/02517

PCT Pub. Date: Jan. 20, 2000

(30) Foreign Application Priority Data

Jul. 11, 1998 (DE) ..... 198 31 235

(51) Int. Cl.[7] ..... B65D 39/00

(52) U.S. Cl. ..... 215/247; 215/261

(58) Field of Search ..... 215/247, 261, 215/248, 249, 347, 21.1; 220/371; 271/936, 944, 654

(56) References Cited

U.S. PATENT DOCUMENTS 5,137,283 A * 8/1992 Giarrusso et al. ..... 277/1

FOREIGN PATENT DOCUMENTS

DE 29706159 * 8/1997

* cited by examiner

*Primary Examiner*—Lee Young
*Assistant Examiner*—Lien Ngo
(74) *Attorney, Agent, or Firm*—Heslin Rothenberg Farley & Mesiti, P.C.

(57) ABSTRACT

A sterile connector for containers holding medicinal liquids comprising a base body with a lower part that can be inserted into the container wall and which can be sealed with respect to the container wall and an upper part equipped with a passage for the liquid. At the lower side and/or the upper side of the base body a barrier module is provided that is an injection molded part with a core made of a material that is essentially impermeable to certain gases and an envelope made of a material of which the base body is made. The connector together with the barrier module offers improved gas tightness and can be manufactured cost-effectively in large numbers

12 Claims, 4 Drawing Sheets

STERILE CONNECTOR FOR CONTAINERS WHICH CONTAIN MEDICINAL LIQUIDS

The invention relates to a sterile connector for containers which contain medicinal liquids, in particular liquids used in enteral feeding.

The packaging of sensitive products requires containers with very effective barrier characteristics, since otherwise there would be a risk of undesired reactions of oxygen with the product contained therein. Glass or metal containers have very satisfactory barrier characteristics. On the other hand, plastic containers are more problematic when used for the storage of sensitive contents.

Conventional plastic containers used for holding enteral nutrient solutions are comprised of laminated film that are sufficiently tight with respect to diffusion. Nevertheless, there is the disadvantage that the connector (port) that is generally made of polyolefins, in particular polypropylene, of the conventional film bag is permeable to certain gases. Therefore there is the risk of undesired reactions of the contents with oxygen. Also, aromatic substances present in the contents may diffuse through the connector. In practice, a decrease in the vitamin C content over time has been demonstrated in the storage of nutrient solutions. Thus, the shelf life of the product is limited.

DE 297 06 159 proposes application of a barrier module in the form of a flexible plastic foil made of a material having adequate diffusion tightness to the underside of the connector facing the container. The barrier module creates a barrier layer between the container contents and the connector that prevents the passage of gases or at least substantially limits it.

In one preferred embodiment of the film bag described in DE 297 06 159 the film piece provided for the purpose of sealing the bottom part of the connector is a laminated foil known in the art and based on a gas-tight metallic foil material with a coating of plastic material that can be bonded to the connector. The disadvantage is that said foils are not pure grade. Bonded connectors using EVOH foil are also known in the art. The use of EVOH as a barrier material is, however, disadvantageous inasmuch as the exposed cut edges of the foil piece are very sensitive, since the foil is cut or punched from a flat foil band that is cut into strips. Thus, it has been demonstrated that at the exposed cut edges increased discoloration and delamination occur after temperature and moisture stressing, as occurs in the sterilization process. Furthermore direct interactions between the internally situated foil components and the product cannot be excluded.

A further disadvantage presented by the barrier module in the form of flexible foil pieces is that form-fit and force-fit connections are not possible. In this respect the available bonding techniques are limited.

In order to establish a satisfactory barrier the entire upper and/or lower side of the connector should be covered by the barrier module. This is, however, only possible in part with the foil bonding when welded beneath. It has been shown in practice that with a slight overlap of the welded foil piece, the foil piece can slit the bag foil situated perpendicular to it. Therefore, it is necessary to maintain sufficient edge clearance, for which reason the entire area of the upper and/or lower side of the connector cannot be covered. Particularly in the case of small structural components, this area consideration can no longer be ignored.

Furthermore, the bonding of the foil piece with the connector is relatively costly. The cost corresponds approximately to that of welding the connector into the collapsible film bag. In addition, loss of tightness or leakage could occur at the weld seams.

The purpose of the invention is to provide a sterile connector that assures a high degree of gas-tightness, is easy to handle, and can be manufactured economically in large numbers.

In the connector pursuant to the invention the barrier module is an injection molded piece with a core and an envelope. The core is comprised of a material that is substantially impermeable for certain gases, while the envelope is comprised of a material corresponding to that of the base body, such that the base body and the injection molded part can be bonded or welded to each other.

When the sterile connector is welded into a collapsible bag the bag material can be bonded both with the base body, which is comprised of a material that can be bonded with or welded to the foil, and bonded or welded with the barrier module, which is comprised of the same material as the base body. Thus, it is possible to seal the container connection almost completely gas-tight.

Based on the formal freedom in injection molding, various connection techniques are available for the fastening of the barrier module. The barrier module can be manufactured economically and with low tolerances in large quantities as an injection molded piece. This can be accomplished using conventional extruders that have two plasticizer groups. Using the extruder, first the sheath and then the core is injected into a tool cavity. This process is also known as sandwich (injection) molding or the co-injection molding process.

The advantage is that the sandwich structure of the barrier module injection molded in one piece is relatively robust. Exposed edges, as in the case of the EVOH foils, that can lead to delamination and discoloration because of high temperatures and humidities, as occur in sterilization, do not occur in the barrier module.

In a preferred embodiment of the invention, the barrier module is welded onto the base body.

In a further preferred embodiment of the invention, the barrier module and the base body are bonded together by form-fit and/or force-fit methods. Thus, for example, the barrier module can be fastened to the base body using a snap or clamp-connection.

Also possible are one-piece component structures of base body and barrier module. Base body and barrier module can, for example, be held together by foil hinges so that said parts can be folded together and firmly bonded together after injection molding.

The barrier module preferably forms a puncturable membrane for closure of the passage into the connector that can be punctured by using a spike.

In order to facilitate the puncturing using the spike, the barrier module in the region of the passage is provided with an appropriate vulnerable area.

In a preferred embodiment the barrier module is a plate that covers the lower and/or upper side of the base body.

In another preferred embodiment the barrier module is fastened moveably to the base body in an intermediate position between a position closing the passage and a position opening the passage. Thus the barrier module simultaneously forms a seal or obturation that is actuated by the connection spike (33). For the purpose of significantly enhancing the gas barrier the barrier module preferably exhibits an oxygen barrier smaller than 1 $cm^3/m^2d$ bar. The material comprising the essentially diffusion-tight core of the barrier module is preferably EVOH (ethylene vinyl alcohol copolymer) or PA (polyamide). The envelope of the barrier module is preferably comprised of polypropylene such that conventional bag foils, which present a seal layer on their inside made of the same material, can be easily welded with the barrier module. The parts so welded with each other exhibit a higher melting point than the sterilization temperature and can thus be sterilized in the autoclave.

The connector pursuant to the invention can be used in medical packaging units of the most varied forms. A preferred area of application is with a medical solution or medicinal liquid, in particular a collapsible bag filled with a solution or liquid for enteral feeding.

In the following an embodiment of the invention is described in more detail with reference to the figures.

Figure 1:
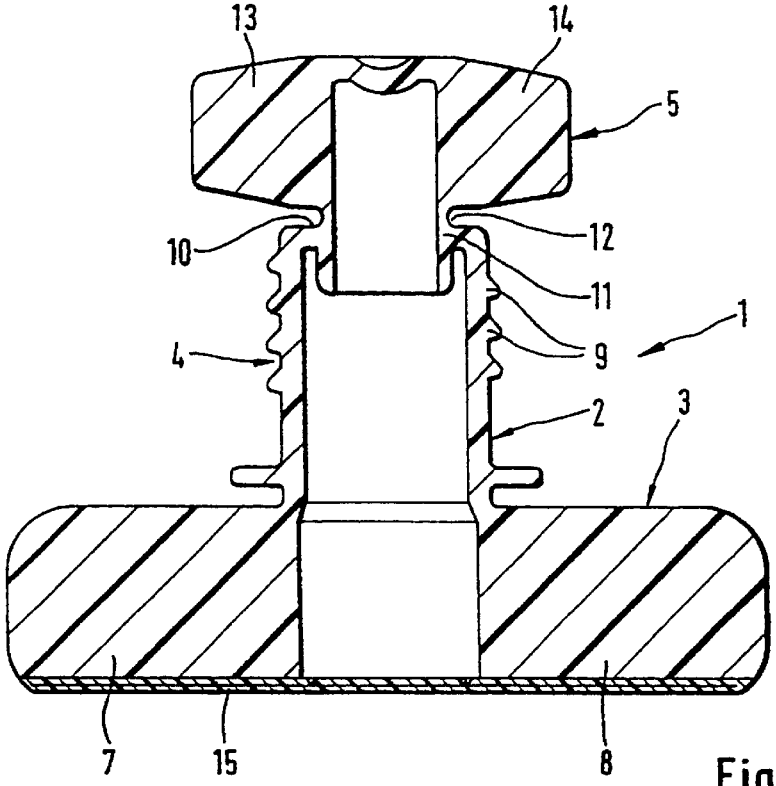
FIG. 1 illustrates a preferred embodiment of the connector in cross-section.
Figure 2:
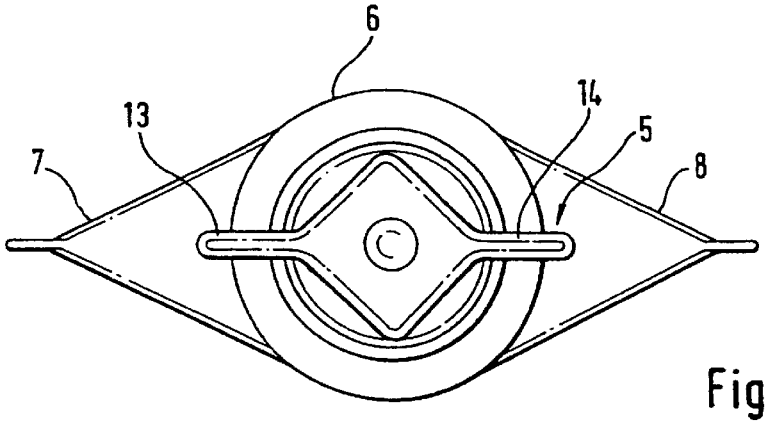
FIG. 2 illustrates the connector in a top plan view.
Figure 3:
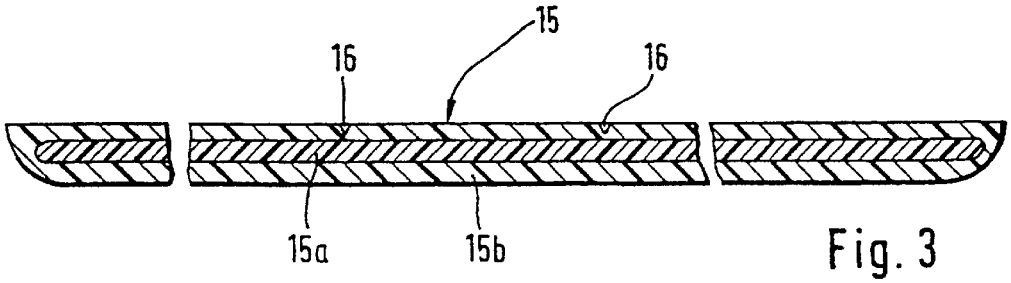
Figure 4:
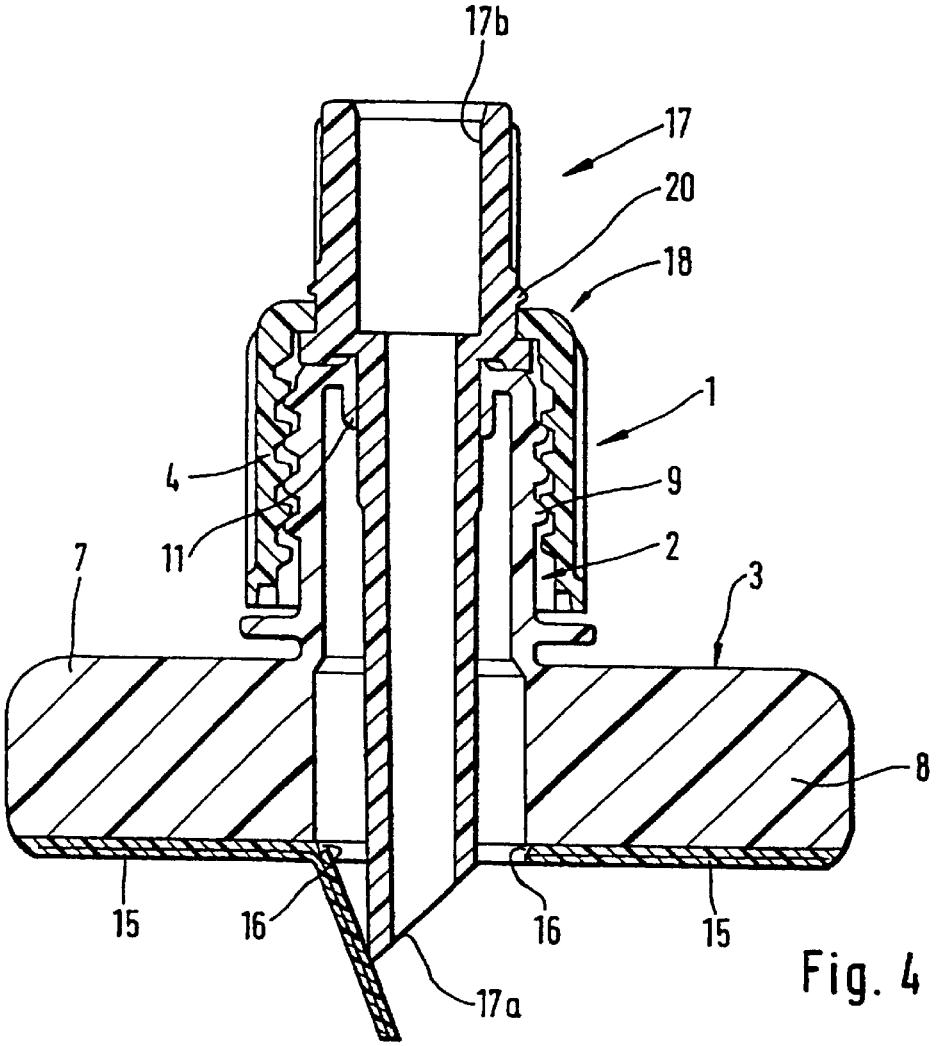
Figure 6:
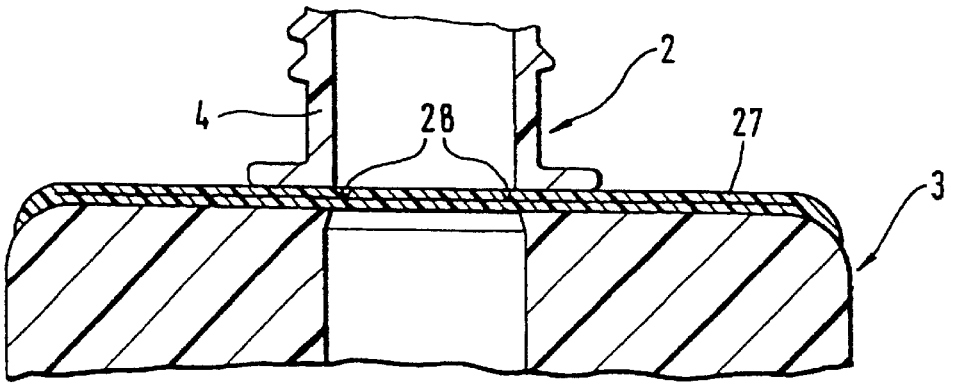
Figure 5A:
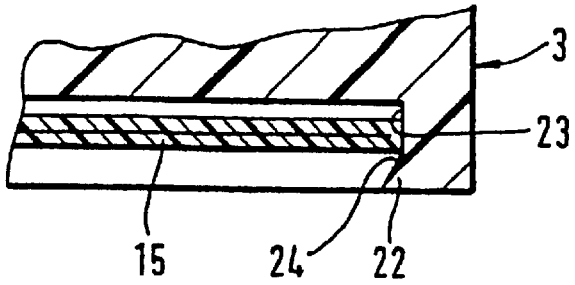
Figure 5B:
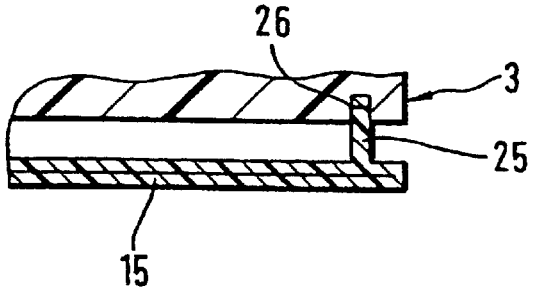
Figure 5C:
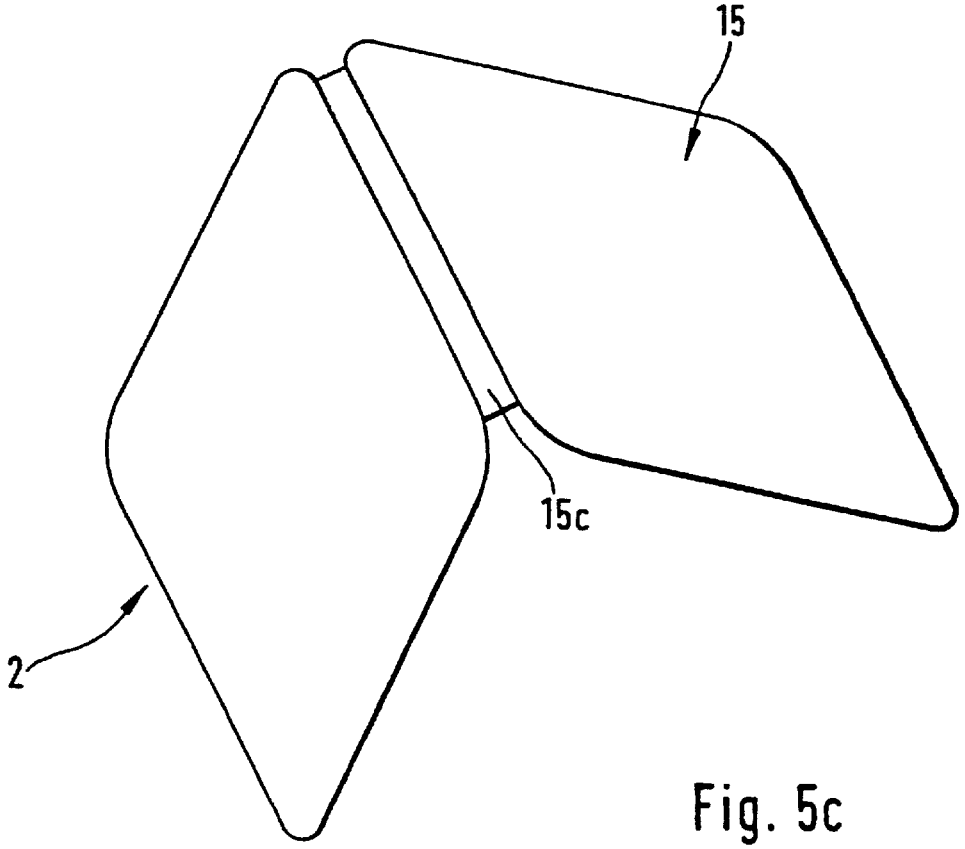
Figure 7:
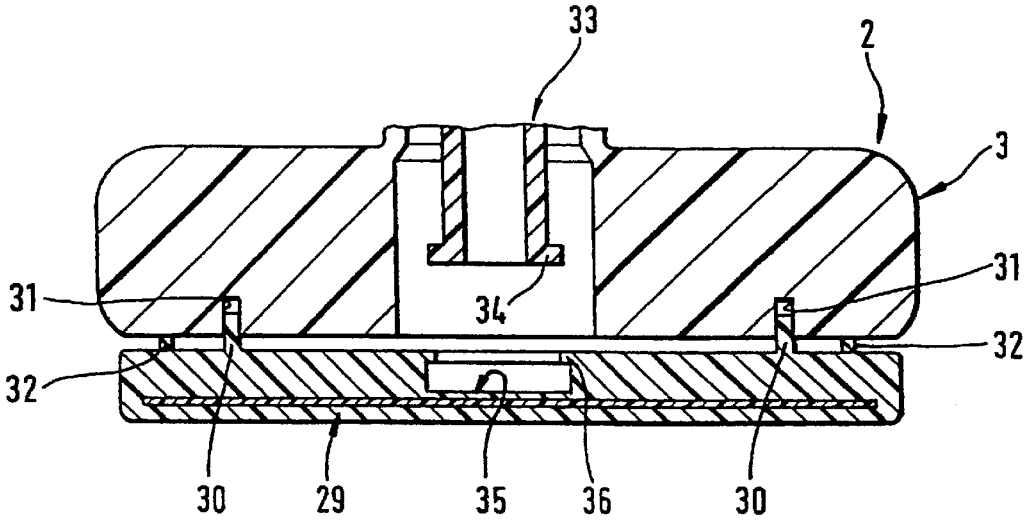

FIG. 3 illustrates the connector in an enlarged cutaway view through the barrier module, FIG. 4 illustrates a preferred embodiment of a connector assembly comprised of the connector shown in FIG. 1 and a perforation spike with an adjusting nut, wherein the barrier module has been pierced, FIGS. 5*a* to 5*c* illustrates various connection methods for fastening the barrier module to the base body of the connector, FIG. 6 illustrates a partial view of another embodiment of a connector, whose barrier module is fastened to the upper side of the base body, FIG. 7 illustrates a further embodiment of a connector, whose barrier module is executed as a movable seal for the passage of the connector.

The connector (1) that is produced as an injection molded piece includes a base body (2) with a boat-shaped lower part (3) and a tubular upper part (4) as well as a protective cap (5). The lower part (3) exhibits a tubular section (6) that is provided with two radially projecting wing-like pieces (7, 8) that lie in one plane. The lower part (3) is welded with the inside of the bag foil of the conventional collapsible bag for medicinal liquids and medical solutions.

The tubular upper part (4) which connects to the lower part (3) is provided with an external threading (9) for screwing on the coupler nut. On its upper rim the upper part (4) exhibits an inwardly extending flange (10) that continues into a female part (11) for anti-swivel accommodation of a perforation spike. The protective cap (5) obturating the upper part (4) of the connector (1) is, in the area of its lower edge, provided with an annular fracture zone (12) and connected with the flange (11) of the upper part (4). The protective cap (5) that is executed as a snap-off piece is provided with two radially protruding wings (13, 14). In order to open the connector, the protective cap is turned around its longitudinal axis so that its wall breaks at the annular fracture zone (12).

A barrier module (15) is provided on the underside of the lower part (3) of the base body (2) facing the container. The barrier module (15) is a plate-like injection molded part that is injection molded in one piece having a sandwich structure. It covers the entire underside of the base body and is welded to the base body.

FIG. 3 illustrates the sandwich structure of the barrier module. The injection molded part exhibits a core (15*a*) comprised of a material that is essentially impermeable for certain gases. The core is comprised of a gas-impermeable material like EVOH (ethlyene vinyl alcohol copolymer) and forms an oxygen barrier of less that 20 $cm^3/m^2d$, preferably less than 1 $cm^3/m^2d$ bar. The core (15*a*) is enclosed in a envelope (15*b*) comprised of the same material as that comprising the base body (2). Since the envelope (15*b*) and the base body (2) are comprised of polypropylene the barrier module and the base body can be bonded with each other. At the same time the welding of the bag foil with the edge of the barrier module (15) is also possible.

On its upper side, facing the base body, the barrier module (15) is provided with an annular fracture zone (16) whose diameter corresponds to that of the passage in the base body so that the barrier module can be pierced when the perforation spike is introduced.

FIG. 4 illustrates the connector assembly consisting of the connector (1) and the perforation spike (17) with the coupling nut (18). The tubular spike (17) exhibits at its one end a point (17*a*) and can be connected at its distal end to the plastic tubing of a flexible tubing delivery system (not shown in the Figures), which is threaded onto the upper flange of the spike. The spike forms a seal against the internal female part (11) of the upper part of the connector (4). The coupling nut is prevented from detachment and loss by a band (20) running circumferentially at the terminal part of the spike on the tubing side.

FIGS. 5*a* to 5*c* illustrate various connecting techniques for attaching the barrier module (15) to the base body (2) of the connector.

FIG. 5*a* illustrates a snap-on connection. The lower part (3) of the base body exhibits on its underside a circumferential ridge (22) that is undercut or sloped. The barrier module (15) is dimensioned so that it can be inserted and fits into the recess (23) of the base body and is caught and secured by the undercut (24).

FIG. 5*b* illustrates a clamp connection of the barrier module (15). The barrier module exhibits on its upper side several conical pins (25) that are distributed circumferentially. On the underside of the lower part (3) of the base body the corresponding recesses (26) are provided, into which the pins of the barrier module can be inserted.

FIG. 5*c* illustrates an embodiment in which the barrier module together with the base body of the connector is manufactured as an injection molded part. The barrier module (15) and the base body (2) are held together with a foil hinge (15*c*). After injection molding the barrier module is folded onto the underside of the base body and these two parts are welded together.

FIG. 6 illustrates a partial view of a further embodiment of the connector. This embodiment example differs from the embodiments described and referred to in FIGS. 1 to 4 in that the barrier module (27) is not fastened to the underside of the lower part (3) of the base body (2), but is fastened onto its upper side. The barrier module (27) is formed together with the upper part (4) of the connector as an injection molded part. In the area of the connector passage the barrier module is provided with the annular fracture zone (28). The upper part of the base body together with the barrier module are welded with the lower part of the base body.

In the embodiment of the invention shown in FIG. 7 the barrier module (29) comprised of the core and envelope is configured as a sealing element. The barrier module exhibits on its upper side a circumferential ridge (30) or circumferentially arranged guide pins, whereby on the underside of the lower part (3) of the base body (2) of the connector, an annular depression (31) or corresponding recesses are provided, into which the circumferential ridge (30) or the guide pins of the barrier module (29) easily catch and bind so that the barrier module in order to open the base body passage is pushed aside or, for the purpose of closing the passage of the base body the barrier module is drawn onto the base body. For the purpose of sealing the barrier module (29) against the lower part (3) of the base body an annular gasket (32) is provided on the outside of the circumferential ridge (30) on the upper side of the barrier module.

Actuation of the seal is accomplished by means of the connection spike (33) which, in lieu of the piercing spike of the embodiments described above, is introduced into the channel-like recess of the connector. The connection spike (33) exhibits on its lower end a circumferential flange (34), while the barrier module (29) is provided with a cylindrical recess (35) with an inwardly projecting flange (36) at whose upper edge and into which the lower end of the connection spike (33) can be snapped in and secured. When the connection spike is pushed in, its circumferential flange (34) is overlapped by the flange (36) at the upper edge of the recess (35). For opening or closing the connector the connection spike (33) is pushed forward or backward, respectively, whereby the barrier module (29) configured as a seal element is actuated.

What is claimed is:

1. A sterile connector for a medicinal liquid container comprising a base body having a lower part that can be inserted into a wall of the container and sealed against the container wall and an upper part with a passage for the liquid, wherein an at least partially covering barrier module comprised of a material that is substantially impermeable for certain gases is provided on the base body on at least one of an upper side facing away from the container and an underside facing the container, and wherein the barrier module is an injection molded part having a core comprised of the material that is substantially impermeable for certain gases and an envelope comprised of a material of which the base body is made.

2. A connector as recited in claim 1 wherein the barrier module is welded to the base body.

3. A connector as recited in claim 1 wherein the barrier module and the base body are connected by at least one of form-fit and force-fit methods.

4. A connector as recited in claim 1 wherein the upper part of the base body is so configured to admit a piercing spike and the barrier module is one piece with a puncturable membrane that closes off the passage into the base body.

5. A connector as recited in claim 4 wherein the barrier module is provided with a fracture zone in an area of the passage.

6. A connector as recited in claim 1 wherein the barrier module comprises a plate covering at least one of an upper side and a lower side of the base body.

7. A connector as recited in claim 1 wherein the barrier module is attached to the base body in an intermediate position between a position closing the passage and a position opening the passage.

8. A connector as recited in claim 1 wherein the core of the barrier module is comprised of a material that acts as an oxygen barrier of less that 20 $cm^3/m^2d$ bar.

9. A connector as recited to claim 8 wherein the material comprising the core of the barrier module comprises EVOH.

10. A connector as recited in claim 1 wherein the material comprising the envelope of the barrier module comprises a polyolefin.

11. A connector as recited in claim 1, wherein the material comprising the envelope of the barrier module comprises polypropylene.

12. A connector as recited in claim 1 wherein the core of the barrier module is comprised of a material that acts as an oxygen barrier of less then 1 $cm^3/m^2d$ bar.

* * * * *

UNITED STATES PATENT AND TRADEMARK OFFICE

CERTIFICATE OF CORRECTION

PATENT NO. : 6,364,143 B1
DATED : April 2, 2002
INVENTOR(S) : Knierbein

It is certified that error appears in the above-identified patent and that said Letters Patent is hereby corrected as shown below:

Column 6,
Line 21, delete the word "that" and insert -- than --

Signed and Sealed this

Fourth Day of June, 2002

*Attest:*

*Attesting Officer*

JAMES E. ROGAN
*Director of the United States Patent and Trademark Office*